US006652910B2

(12) United States Patent
Pan et al.

(10) Patent No.: US 6,652,910 B2
(45) Date of Patent: Nov. 25, 2003

(54) APPARATUS AND METHOD FOR CONTROLLING COATING SOLUTION LEVEL WITHIN SUBSTRATE

(75) Inventors: Sean X. Pan, Penfield, NY (US); Mark C. Petropoulos, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 143 days.

(21) Appl. No.: 09/683,742

(22) Filed: Feb. 8, 2002

(65) Prior Publication Data

US 2003/0152697 A1 Aug. 14, 2003

(51) Int. Cl.[7] ..... B05D 7/22; B05D 1/18; B05C 3/02; B05C 11/10

(52) U.S. Cl. ..... 427/238; 427/430.1; 118/407; 118/423; 118/429; 118/692; 118/694; 118/DIG. 11; 118/DIG. 12

(58) Field of Search ..... 118/50, 400, 404, 118/407, 423, 429, 692, 693, 694, DIG. 11, DIG. 12, 712; 427/105, 230, 238, 430.1; 137/14, 215; 261/24, 72.1, 73; 417/437; 454/255

(56) References Cited

U.S. PATENT DOCUMENTS 4,448,798 A * 5/1984 Kageyama et al. ..... 427/8
4,620,996 A * 11/1986 Yashiki ..... 427/430.1
5,683,755 A 11/1997 Godlove et al. ..... 427/430.1
5,688,327 A 11/1997 Swain et al. ..... 118/500
5,853,813 A 12/1998 Chambers et al. ..... 427/430.1

FOREIGN PATENT DOCUMENTS

JP 58-074170 A * 5/1983 ..... B05D/1/18

* cited by examiner

*Primary Examiner*—Bret Chen
*Assistant Examiner*—William Phillip Fletcher, III
(74) *Attorney, Agent, or Firm*—Zosan S. Soong

(57) ABSTRACT

An apparatus, to be used when an open end of a hollow substrate contacts a coating solution to define a solution free interior portion of the substrate, for controlling the level of the coating solution relative to the substrate interior, the apparatus including: a gas container capable of changing in volume; a channel connecting the gas container to the solution free interior portion of the substrate to allow gas flow in either direction between the gas container and the solution free interior portion; and pressure means for exerting a changeable, continuous pressure on the gas container that automatically exerts an increasingly greater pressure on the gas container as the gas container expands in volume and that automatically exerts a decreasingly lesser pressure on the gas container as the gas container decreases in volume.

15 Claims, 6 Drawing Sheets

APPARATUS AND METHOD FOR CONTROLLING COATING SOLUTION LEVEL WITHIN SUBSTRATE

BACKGROUND OF INVENTION

Two major problems in dip coating hollow substrates that affect coating quality are burping and sucking. Burping refers to the release of gas from the substrate interior into the coating solution and is caused by volume expansion of the gas inside the substrate due to solvent evaporation in the substrate interior. Sucking refers to the entry of coating solution into the substrate interior and is caused by the volume reduction of the gas inside the substrate due to cooling. Conventional techniques for controlling the substrate interior pressure typically involve timed venting which uses a venting hole in the chuck assembly (holding the substrate) that is normally closed by a valve. The valve is opened once or more during the dip coating process for a certain period of time to relieve the pressure buildup inside the substrate to avoid burping. So the term timed means a set time to open the valve as well as the period of time it opens. Timed venting, however, does not address sucking and normally makes sucking worse if the valve is opened too long or prematurely opened. There is a need which the present invention addresses for new apparatus and methods which avoid or minimize the above mentioned problems.

Swain et al., U.S. Pat. No. 5,688,327; Chambers et al., U.S. Pat. No. 5,853,813; and Godlove et al., U.S. Pat. No. 5,683,755 disclose techniques for controlling the substrate interior pressure.

SUMMARY OF INVENTION

The present invention is accomplished in embodiments by providing an apparatus, to be used when an open end of a hollow substrate contacts a coating solution to define a solution free interior portion of the substrate, for controlling the level of the coating solution relative to the substrate interior, the apparatus comprising: a gas container capable of changing in volume; a channel connecting the gas container to the solution free interior portion of the substrate to allow gas flow in either direction between the gas container and the solution free interior portion; and pressure means for exerting a changeable, continuous pressure on the gas container that automatically exerts an increasingly greater pressure on the gas container as the gas container expands in volume and that automatically exerts a decreasingly lesser pressure on the gas container as the gas container decreases in volume.

In further embodiments, there is provided an apparatus, to be used when an open end of a hollow substrate contacts a coating solution to define a solution free interior portion of the substrate, for controlling the level of the coating solution within the substrate interior, the apparatus comprising: a gas container capable of changing in volume and having an elastic property that spontaneously exerts increasingly greater pressure on the contained gas as the gas container increases in volume and that spontaneously exerts decreasingly lesser pressure on the contained gas as the gas container decreases in volume; and a channel connecting the gas container to the solution free interior portion of the substrate to allow gas flow in either direction between the gas container and the solution free interior portion.

In other embodiments, there is provided a method, to be used when an open end of a hollow substrate contacts a coating solution to define a solution free interior portion of the substrate, for controlling the level of the coating solution relative to the substrate interior, the method comprising: establishing a channel to allow gas flow in either direction between a gas container capable of changing in volume and the solution free interior portion; and exerting a changeable, continuous pressure on the gas in the gas container that automatically exerts an increasingly greater pressure on the gas in the gas container as the gas container expands in volume and that automatically exerts a decreasingly lesser pressure on the gas in the gas container as the gas container decreases in volume.

BRIEF DESCRIPTION OF DRAWINGS

Other aspects of the present invention will become apparent as the following description proceeds and upon reference to the Figures which represent preferred embodiments.

Unless otherwise noted, the same reference numeral in different Figures refers to the same or similar feature.

DETAILED DESCRIPTION

Figure 1:
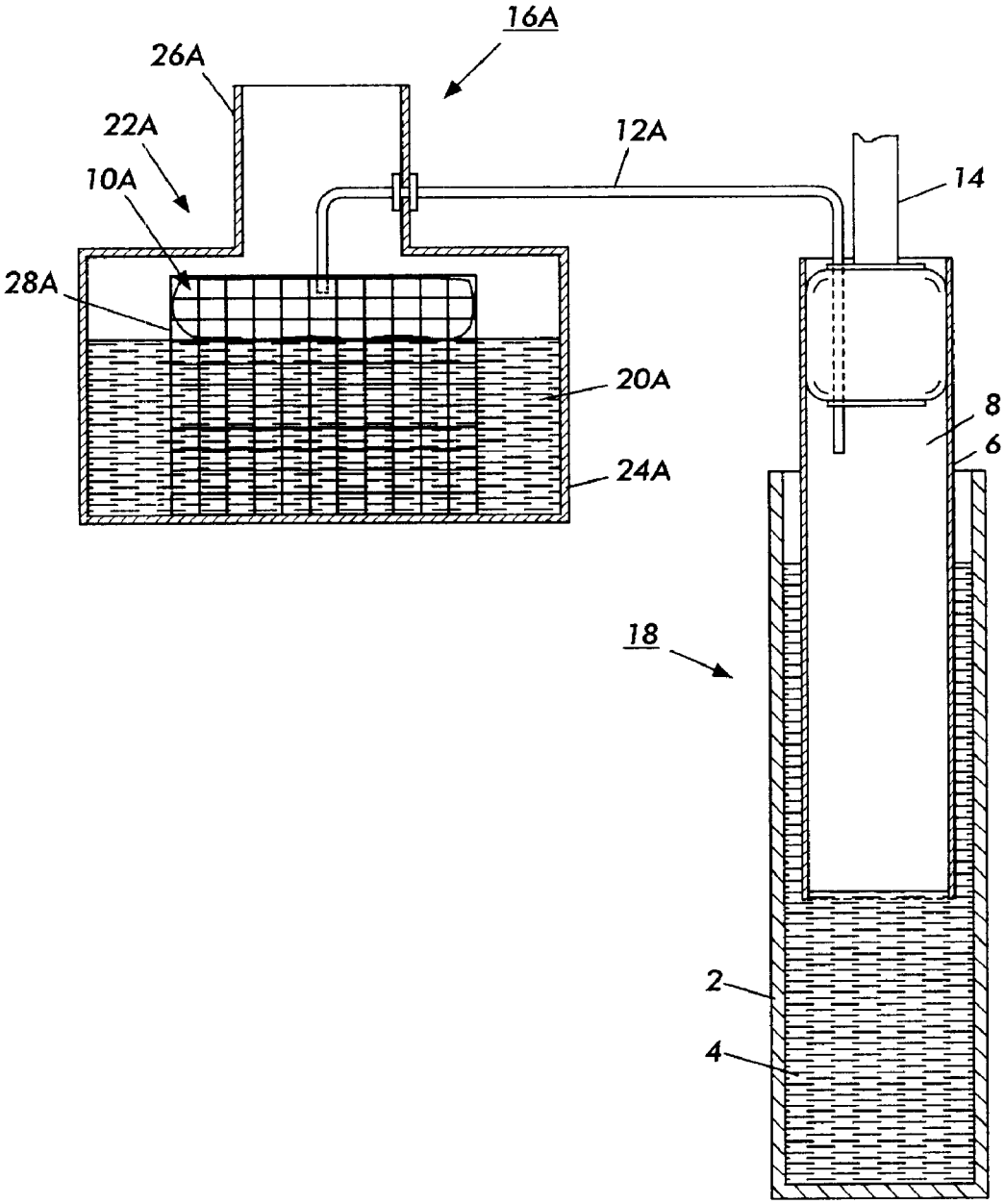
FIG. 1 represents a schematic elevational view in cross-section of a first embodiment of the present invention.

FIG. 1 depicts coating vessel 2, coating solution 4, hollow substrate 6 a part of which is submerged in the coating solution to define solution free interior portion 8, gas container 10A, channel 12A connecting the gas container to the solution free interior portion of the substrate, chuck assembly 14 for holding the substrate and including a passageway to accommodate the channel, and pressure means 16A. Coating equipment 18 collectively refers to the coating vessel 2, the coating solution 4, the substrate 6 (with solution free interior portion 8), and the chuck assembly 14. The pressure means 16A is composed of liquid 20A in tank assembly 22A (having lower tank 24A and upper tank 26A where the upper tank provides space for the level of the liquid to rise), and an optional cage 28A having a plurality of openings to allow the liquid to contact the gas container. The liquid may be for instance water, solvents, coating solutions or special solutions with a particular gravity.

Operation of the apparatus disclosed in FIG. 1 will now be discussed. When the gas pressure of the solution free interior portion is higher than the gas pressure inside the gas container (due to for example, deeper insertion of the substrate into the coating solution and/or evaporation of the coating solution which introduces additional gas molecules into the solution free interior portion), gas flows from the solution free interior portion to the gas container through the channel due to the pressure differential. The gas container expands due to the incoming gas. The gas container is restrained laterally by the cage so that the gas container only expands downward along the boundary set by the cage. Expansion of the gas container raises the level of the liquid in the tank assembly, which increases the hydraulic pressure exerted by the liquid on the gas container. The increased hydraulic pressure on the gas container quickly equalizes the gas pressure of the solution free interior portion and the gas pressure inside the gas container, thereby minimizing any change in the level of the coating solution within the substrate interior.

When the gas pressure of the solution free interior portion is lower than the gas pressure inside the gas container (due to for example, raising the substrate from the coating solution and/or cooling of the gas molecules in the solution free interior portion), gas flows from the gas container to the solution free interior portion through the channel due to the pressure differential. The gas container contracts due to the exiting gas. The gas container is restrained laterally by the cage so that the gas container only contracts upwardly along the boundary set by the cage. Contraction of the gas container lowers the level of the liquid in the tank assembly, which decreases the hydraulic pressure exerted by the liquid on the gas container. The decreased hydraulic pressure on the gas container quickly equalizes the gas pressure of the solution free interior portion and the gas pressure inside the gas container, thereby minimizing any change in the level of the coating solution within the substrate interior.

In the embodiment of FIG. 1, the pressure exerted by the pressure means has a positive correlation with the volume of the gas container, i.e., both parameters increase or decrease together.

For simplicity, the coating equipment 18 depicted in FIG. 1 is not shown in subsequent FIGS. 2–6, but it is understood that the apparatus depicted in FIGS. 2–6 can operate in conjunction with the coating equipment 18 depicted in FIG. 1.

Figure 2:
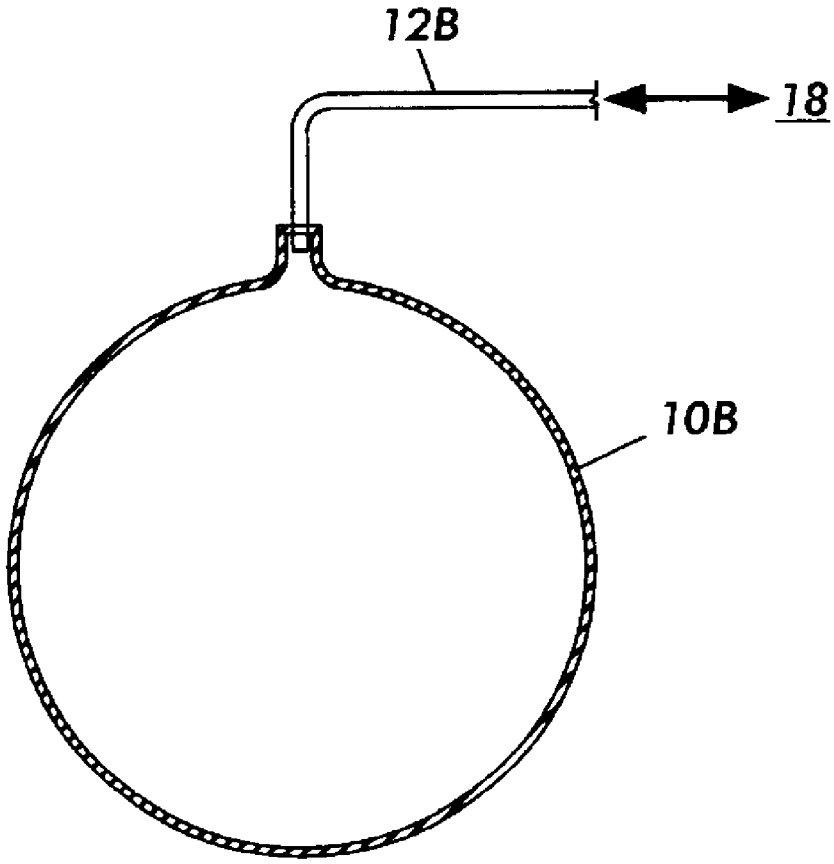
FIG. 2 represents a schematic elevational view in cross-section of a second embodiment of the present invention.

FIG. 2 depicts a gas container 10B having an elastic property that spontaneously exerts increasingly greater pressure on the contained gas as the gas container expands (from an inflow of gas molecules) and that spontaneously exerts decreasingly lesser pressure on the contained gas as the gas container decreases in volume (from the outflow of gas molecules). Channel 12B connects the gas container to the solution free interior portion of the substrate (not shown).

Operation of the apparatus disclosed in FIG. 2 will now be discussed. When the gas pressure of the solution free interior portion is higher than the gas pressure inside the gas container, gas flows from the solution free interior portion to the gas container through the channel due to the pressure differential. The gas container expands due to the incoming gas. Due to its elastic property, as the gas container expands, it exerts an increasingly greater pressure on the contained gas. Due to the increased pressure exerted by the gas container, the gas pressure of the contained gas is quickly equalized with the gas pressure of the solution free interior portion, thereby minimizing any change in the level of the coating solution within the substrate interior.

When the gas pressure of the solution free interior portion is lower than the gas pressure inside the gas container, gas flows from the gas container to the solution free interior portion through the channel due to the pressure differential and facilitated by the elastic property of the gas container. The gas container contracts due to the exiting gas and exerts a decreasingly lower pressure on the contained gas. The decreased pressure exerted by the gas container quickly equalizes the gas pressure of the contained gas with the gas pressure of the solution free interior portion, thereby minimizing any change in the level of the coating solution within the substrate interior.

Figure 3:
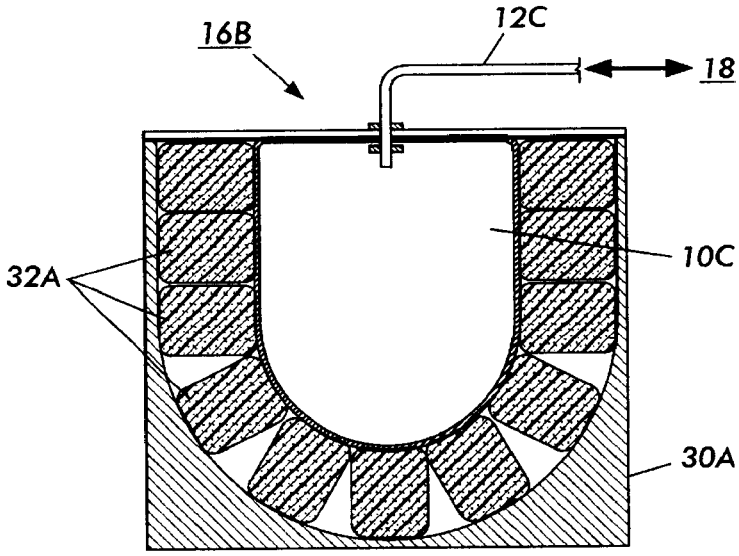
FIG. 3 represents a schematic elevational view in cross-section of a third embodiment of the present invention.

FIG. 3 depicts gas container 10C, channel 12C connecting the gas container to the solution free interior portion of the substrate (not shown), and pressure means 16B. Pressure means 16B is composed of vessel 30A and therein at least one compressible member 32A that when compressed spontaneously expands upon lessening of the compressive force. The number of compressible members arranged around the gas container ranges for example from 1 to 20. The compressible member or members may be foam, sacs filled with foam, or any suitable compressible and expandable material. The upper section of the gas container not in contact with the compressible members optionally may be stiffened (such as by positioning against the vessel) to minimize deformation, thereby facilitating exertion of pressure by the compressible member on the gas container.

Figure 4:
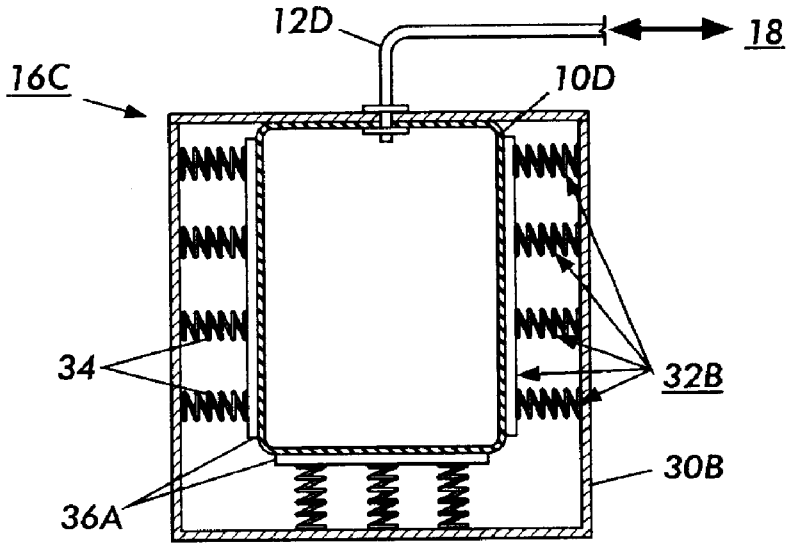
FIG. 4 represents a schematic elevational view in cross-section of a fourth embodiment of the present invention.

FIG. 4 depicts gas container 10D, channel 12D connecting the gas container to the solution free interior portion of the substrate (not shown), and pressure means 16C. Pressure means 16C is composed of vessel 30B and therein at least one compressible member 32B that when compressed spontaneously expands upon lessening of the compressive force. The number of compressible members arranged around the gas container ranges for example from 1 to 20. The compressible member is depicted as a plurality of springs 34 which engages plates 36A. The springs may be mounted to either the plates or the vessel. The upper section of the gas container not in contact with the compressible members optionally may be stiffened (such as by positioning against the vessel) to minimize deformation, thereby facilitating exertion of pressure by the compressible member on the gas container.

Operation of the apparatus disclosed in FIGS. 3–4 will now be discussed. When the gas pressure of the solution free interior portion is higher than the gas pressure inside the gas container, gas flows from the solution free interior portion to the gas container through the channel due to the pressure differential. The gas container expands due to the incoming gas and compresses the compressible members. Due to their elastic property, as the compressible members compress, they exert an increasingly greater pressure on the gas container. Due to the increased pressure exerted by the compressible members, the gas pressure of the contained gas is quickly equalized with the gas pressure of the solution free interior portion, thereby minimizing any change in the level of the coating solution within the substrate interior.

When the gas pressure of the solution free interior portion is lower than the gas pressure inside the gas container, gas flows from the gas container to the solution free interior portion through the channel due to the pressure differential and facilitated by the elastic property of the compressible members. The gas container contracts due to the exiting gas and the compressible members exert a decreasingly lower pressure on the gas container. The decreased pressure exerted by the compressible members on the gas container quickly equalizes the gas pressure of the contained gas and of the solution free interior portion, thereby minimizing any change in the level of the coating solution within the substrate interior.

Figure 5:
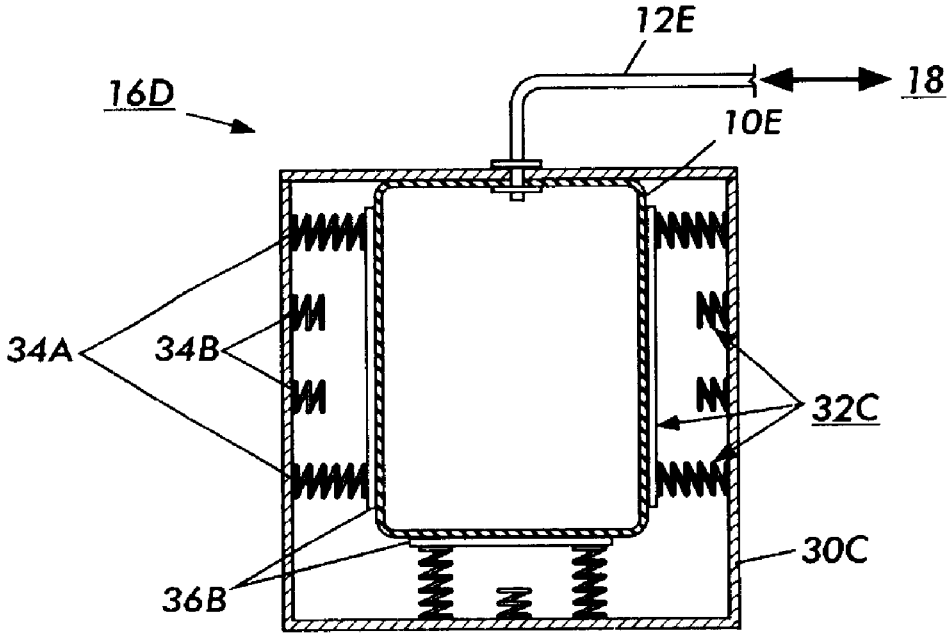
FIG. 5 represents a schematic elevational view in cross-section of a fifth embodiment of the present invention.

FIG. 5 depicts gas container 10E, channel 12E connecting the gas container to the solution free interior portion of the substrate (not shown), and pressure means 16D. Pressure means 16D is composed of vessel 30C and therein at least one compressible member 32C that when compressed spontaneously expands upon lessening of the compressive force. The number of compressible members arranged around the gas container ranges for example from 1 to 20. The compressible member 32C is depicted as a plurality of springs of at least two different lengths (longer springs 34A and shorter springs 34B) which engages plates 36B. The springs may be mounted to either the plates or the vessel. The upper section of the gas container not in contact with the compressible members optionally may be stiffened (such as by positioning against the vessel) to minimize deformation, thereby facilitating exertion of pressure by the compressible member on the gas container.

Operation of the apparatus disclosed in FIG. 5 will now be discussed. When the gas pressure of the solution free interior portion is higher than the gas pressure inside the gas container, gas flows from the solution free interior portion to the gas container through the channel due to the pressure differential. The gas container expands due to the incoming gas and initially compresses only the longer springs. Further expansion of the gas container then engages and compresses the shorter springs. Due to their elastic property, as the compressible members compress, they exert an increasingly greater pressure on the gas container. Due to the increased pressure exerted by the compressible members, the gas pressure of the contained gas is quickly equalized with the gas pressure of the solution free interior portion, thereby minimizing any change in the level of the coating solution within the substrate interior.

When the gas pressure of the solution free interior portion is lower than the gas pressure inside the gas container, gas flows from the gas container to the solution free interior portion through the channel due to the pressure differential and facilitated by the elastic property of the compressible members. The gas container contracts due to the exiting gas and the compressible members exert a decreasingly lower pressure on the gas container. Contraction of the gas container decreases the pressure exerted by the shorter springs and the longer springs, where sufficient contraction of the gas container disengages the shorter springs. The decreased pressure exerted by the compressible members on the gas container quickly equalizes the gas pressure of the contained gas and of the solution free interior portion, thereby minimizing any change in the level of the coating solution within the substrate interior.

The embodiment of FIG. 5 illustrates a step-wise change in the pressure exerted on the contained gas within the gas container in contrast to the continuous change in the pressure exerted on the contained gas by the embodiments of FIGS. 1, 2, 3, and 4.

Figure 6:
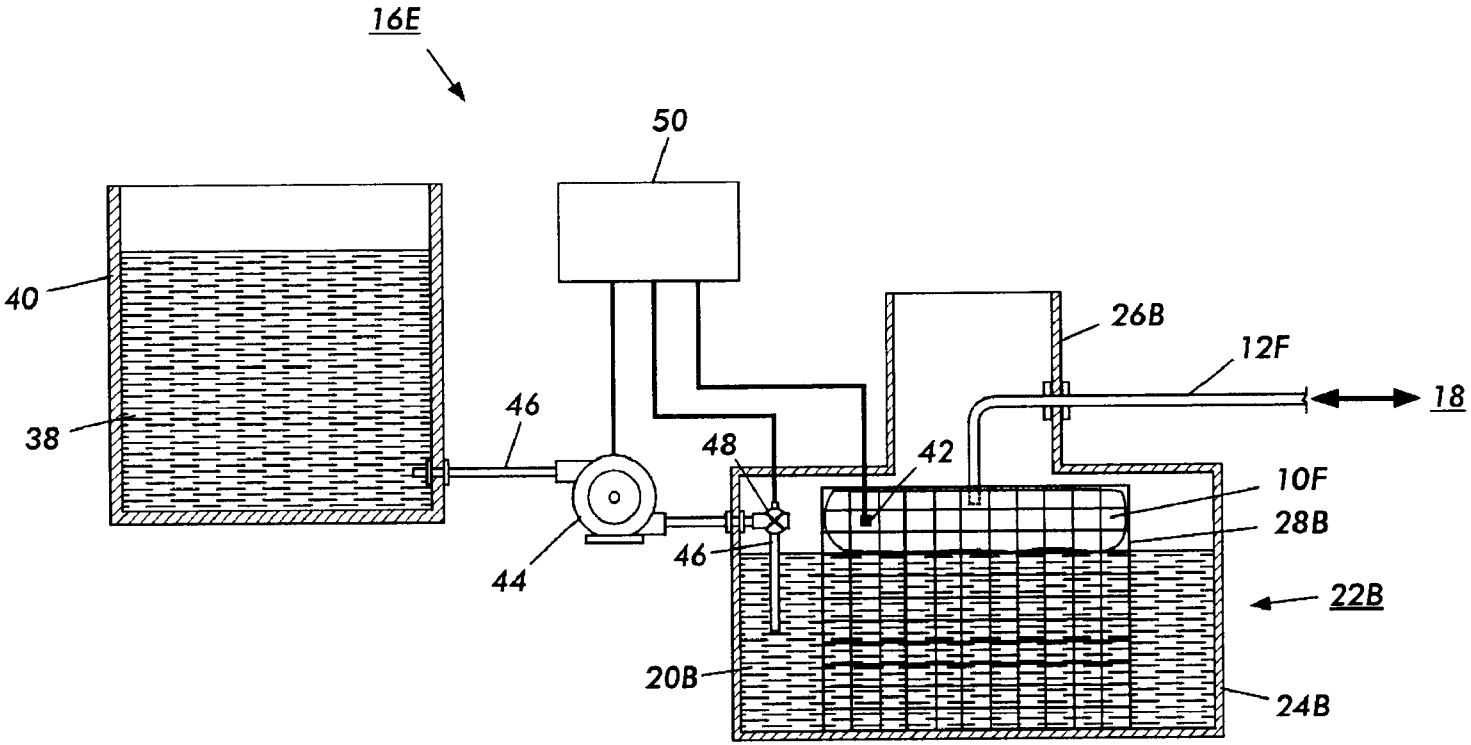
FIG. 6 represents a schematic elevational view in cross-section of a sixth embodiment of the present invention.

FIG. 6 depicts gas container 10F, channel 12F connecting the gas container to the solution free interior portion of the substrate (not shown), and pressure means 16E. The pressure means 16E is composed of a liquid 20B in tank assembly 22B (with lower tank 24B and upper tank 26B), an optional cage 28B having a plurality of openings to allow the liquid to contact the gas container, reserve liquid 38 in a reserve tank 40, sensor 42 coupled to the gas container to monitor the gas pressure therein, a pump 44, reserve liquid conduit 46, valve 48, and controller 50. The controller is operatively coupled to the sensor, valve, and pump. The liquid and reserve liquid may be the same or different and may be for instance water, solvents, coating solutions or special solutions with particular gravity.

Operation of the apparatus disclosed in FIG. 6 proceeds similarly to the embodiment of FIG. 1 with the following modifications. To more precisely control the pressure exerted on the gas container, the sensor provides to the controller information on the gas pressure within the gas container. To counteract a prospective rise in the level of the coating solution relative to the substrate interior, the controller can open the valve and pump reserve liquid from the reserve tank to the tank assembly, thereby increasing the hydraulic pressure exerted on the gas container. To counteract a prospective fall in the level of the coating solution relative to the substrate interior, the controller can open the valve and pump liquid from the tank assembly to the reserve tank, thereby decreasing the hydraulic pressure exerted on the gas container.

The embodiment of FIG. 6 is capable of changing the pressure exerted on the gas container in a step-wise manner or a continuous manner.

As is apparent from the present disclosure, exerting the changeable, continuous pressure on the gas in the gas container encompasses a variety of methods and apparatus including for instance: a pressure means pressing on an elastic or inelastic gas container; and employing an elastic gas container without a pressure means pressing on the gas container. It is understood that the changeable, continuous pressure exerted by the present invention on the gas in the gas container is in addition to the atmospheric pressure (exerted by ambient air) on the gas container.

In embodiments of the present invention, the pressure exerted on the contained gas has a positive correlation with the gas container volume such that the pressure exerted on the contained gas increases with increases in the gas container volume, and the pressure exerted on the contained gas decreases with decreases in the gas container volume. The rate of change of the pressure exerted on the contained gas versus the rate of change of the gas container volume may be any suitable values.

In embodiments, the present invention quickly equalizes the gas pressure of the solution free interior portion and the gas pressure inside the gas container in a time ranging for example from about 10 milliseconds to about 5 seconds (but a time outside this illustrative range is possible).

Any suitable materials, component dimensions, and operating parameters can be used to accomplish the embodiments of FIGS. 1–6 as well as other embodiments of the present invention. The coating solution may be for example one used in dip coating, especially a charge transport coating solution and a charge generating coating solution. The phrase coating solution encompasses any fluid composition including the liquid medium and the coating material regardless of the extent that the coating material may be dissolved in the liquid medium. The gas may be for instance air or nitrogen, or any other suitable gas.

The gas container may be flexible and has an elastic or non-elastic property. Elastic materials for the gas container can be for instance latex (e.g., balloons) of a thickness ranging for example from about 0.1 mm to about 0.3 mm. Non-elastic materials for the gas container can be for instance plastic foil (e.g., balloons) of a thickness ranging from about 0.05 mm to about 0.2 mm. In order to have the gas container compatible to a solvent environment, Teflon or other solvent-resistant coating may be applied to the gas container. Teflon tape materials of a thickness ranging from about 0.05 mm to about 0.2 mm can be also made into the gas container. The gas container may have any suitable flexibility, shape and volume. The gas container may hold a gas volume ranging for example from about 0.075 liter to about 30 liters, particularly from about 0.15 liter to about 2 liters. The pressure exerted on the contained gas within the gas container may range for example from about 2,000 to 22,000 Pa, particularly from about 4,000 to 11,000 Pa.

The substrate may have any suitable shape and size. The present invention can be used with any substrate where it is important to control burping and/or sucking.

Any suitable chuck assembly may be employed such as the chuck assembly disclosed in Swain et al., U.S. Pat. No. 5,688,327, the disclosure of which is totally incorporated herein by reference.

The present invention automatically changes the pressure exerted on the gas in the gas container. The term automatically indicates that such pressure change is accomplished without human intervention and encompasses both passive and active apparatus and methods for accomplishing such pressure change. In embodiments of the present invention such as those illustrated in FIGS. 1–5, the pressure exerted on the gas in the gas container is changed passively, i.e., without electrical power requiring apparatus such as pumps, electrical and/or electronic devices by relying solely on the physical properties of the gas container and/or pressure means. In embodiments of the present invention such as those illustrated in FIG. 6, the pressure exerted on the gas in the gas container is changed actively, i.e., by employing electrical power requiring apparatus such as pumps, electrical and/or electronic devices in addition to or in place of reliance on the physical properties of the gas container and/or pressure means.

The present invention minimizes a change in the level of the coating solution relative to the substrate interior. In embodiments, however, the present invention may still result in a change in the coating solution level relative to the substrate interior, but such a change is much less than would have occurred in the absence of the present invention. The level of the coating solution relative to the substrate interior may vary depending on the parameters of the coating method. The level of the coating solution within the substrate interior may range for example from 0 to about 30 mm along the length of the substrate.

Embodiments of the present invention may be used for instance in dip coating or a similar process that involves volatile solvents within an enclosed space. In embodiments, the present invention can adjust the pressure automatically in any or all of the following circumstances: (1) a product property change in for example temperature, solvent composition and concentration; (2) employing a different chuck assembly that changed the air volume inside the substrate; (3) a process change involving for example the substrate length or diameter, the extent of coating solution deposition on the substrate, or the coating speed; and (4) a process environment change involving for example a temperature change of the substrate, chuck assembly, or air in the coating booth, or an air pressure fluctuation in the coating booth. In the absence of the present invention, one needs to determine the parameters by trial and error for each change in the above circumstances and such parameters are very difficult to optimize. In addition, the known timed venting technique discussed earlier does not address sucking as embodiments of the present invention do.

Other modifications of the present invention may occur to those skilled in the art based upon a reading of the present disclosure and these modifications are intended to be included within the scope of the present invention.

What is claimed is:

1. An apparatus, to be used when an open end of a hollow substrate contacts a coating solution to define a solution free interior portion of the substrate, for controlling the level of the coating solution relative to the substrate interior, the apparatus comprising:

a gas container capable of changing in volume;

a channel connecting the gas container to the solution free interior portion of the substrate to allow gas flow in either direction between the gas container and the solution free interior portion; and pressure means for exerting a changeable, continuous pressure on the gas container that automatically exerts an increasingly greater pressure on the gas container as the gas container expands in volume and that automatically exerts a decreasingly lesser pressure on the gas container as the gas container decreases in volume.

2. The apparatus of claim 1, wherein the pressure means passively accomplishes the changing of the changeable, continuous pressure.

3. The apparatus of claim 1, wherein the pressure means actively accomplishes the changing of the changeable, continuous pressure.

4. The apparatus of claim 1, wherein the pressure means accomplishes the changing of the changeable, continuous pressure in a continuous manner.

5. The apparatus of claim 1, wherein the pressure means accomplishes the changing of the changeable, continuous pressure in a step-wise manner.

6. The apparatus of claim 1, wherein the pressure means includes a liquid such that the changeable pressure is a hydraulic pressure exerted by the liquid.

7. The apparatus of claim 1, wherein the pressure means includes at least one compressible member that when compressed spontaneously expands upon lessening of the compressive force.

8. The apparatus of claim 1, wherein the pressure means includes a pressure monitoring sensor operatively coupled to the gas container.

9. An apparatus, to be used when an open end of a hollow substrate contacts a coating solution to define a solution free interior portion of the substrate, for controlling the level of the coating solution within the substrate interior, the apparatus comprising:

a gas container capable of changing in volume and having an elastic property that spontaneously exerts increasingly greater pressure on the contained gas as the gas container increases in volume and that spontaneously exerts decreasingly lesser pressure on the contained gas as the gas container decreases in volume; and a channel connecting the gas container to the solution free interior portion of the substrate to allow gas flow in either direction between the gas container and the solution free interior portion.

10. A method, to be used when an open end of a hollow substrate contacts a coating solution to define a solution free interior portion of the substrate, for controlling the level of the coating solution relative to the substrate interior, the method comprising:

establishing a channel to allow gas flow in either direction between a gas container capable of changing in volume and the solution free interior portion; and exerting a changeable, continuous pressure on the gas in the gas container that automatically exerts an increasingly greater pressure on the gas in the gas container as the gas container expands in volume and that automatically exerts a decreasingly lesser pressure on the gas in the gas container as the gas container decreases in volume.

11. The method of claim 10, wherein the changeable, continuous pressure is passively changed.

12. The method of claim 10, wherein the changeable, continuous pressure is actively changed.

13. The method of claim 10, wherein the changeable, continuous pressure is changed in a continuous manner.

14. The method of claim 10, wherein the changeable, continuous pressure is changed in a step-wise manner.

15. The method of claim 10, wherein the changeable, continuous pressure is hydraulic pressure exerted by a liquid in contact with the gas container.

* * * * *